US007471800B2

(12) United States Patent
Neilson

(10) Patent No.: US 7,471,800 B2
(45) Date of Patent: Dec. 30, 2008

(54) WAX BARRIER SYSTEM

(75) Inventor: Mark A. Neilson, Zimmerman, MN (US)

(73) Assignee: In'Tech Industries, Inc., Ramsey, MN (US)

( * ) Notice: Subject to any disclaimer, the term of this patent is extended or adjusted under 35 U.S.C. 154(b) by 359 days.

(21) Appl. No.: 10/811,606

(22) Filed: Mar. 29, 2004

(65) Prior Publication Data

US 2006/0147071 A1 Jul. 6, 2006

(51) Int. Cl.
*H04R 25/00* (2006.01)

(52) U.S. Cl. ..... 381/325; 181/135

(58) Field of Classification Search ..... 381/325; 181/135

See application file for complete search history.

(56) References Cited

U.S. PATENT DOCUMENTS

| | | | | |
|---|---|---|---|---|
| 4,870,689 | A | 9/1989 | Weiss | |
| 4,879,750 | A | 11/1989 | Nassler | |
| 4,945,569 | A | 7/1990 | Kulman | |
| 4,972,488 | A | 11/1990 | Weiss et al. | |
| 4,984,277 | A * | 1/1991 | Bisgaard et al. | 381/325 |
| 4,987,597 | A * | 1/1991 | Haertl | 381/325 |
| 5,099,947 | A | 3/1992 | Guggenberger et al. | |
| 5,105,904 | A | 4/1992 | Olsen | |
| 5,278,360 | A | 1/1994 | Carbe et al. | |
| 5,327,500 | A | 7/1994 | Campbell | |
| D355,702 | S | 2/1995 | Johnson | |
| 5,401,920 | A | 3/1995 | Oliveira | |
| 5,535,282 | A | 7/1996 | Luca | |
| 5,712,918 | A | 1/1998 | Yoest | |
| 5,864,628 | A | 1/1999 | Posen et al. | |
| 5,970,157 | A | 10/1999 | Yoest | |
| 5,982,908 | A | 11/1999 | Bauman | |
| 6,105,713 | A | 8/2000 | Brimhall et al. | |
| 6,134,333 | A | 10/2000 | Flagler | |

FOREIGN PATENT DOCUMENTS

| | | |
|---|---|---|
| DE | 3917804 A1 | 12/1990 |
| DE | 10104129 A1 | 8/2002 |
| WO | WO-00/03561 | 1/2000 |

* cited by examiner

*Primary Examiner*—Walter F Briney, III
(74) *Attorney, Agent, or Firm*—Brooks, Cameron & Huebsch, PLLC

(57) ABSTRACT

A customizable cerumen guard for a hearing aid having a shell, a receiver, a receiver tube, and aperture in the shell communicating with the receiver tube, includes an insert insertable into the shell aperture, the insert having a chamber therein, a receiver aperture for communication with the receiver tube, an ear canal aperture communicating with the ear of the wearer; and a plurality of customizable, interchangeable caps covering the ear canal aperture. The cerumen guard may also have any of a number of customizable cerumen-trapping accessories that may be placed into the chamber.

15 Claims, 7 Drawing Sheets

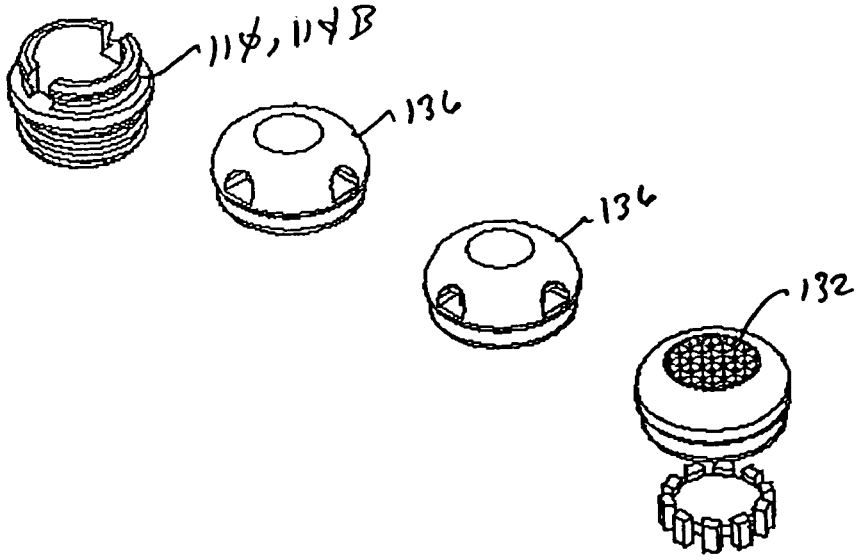
FIG. 7A
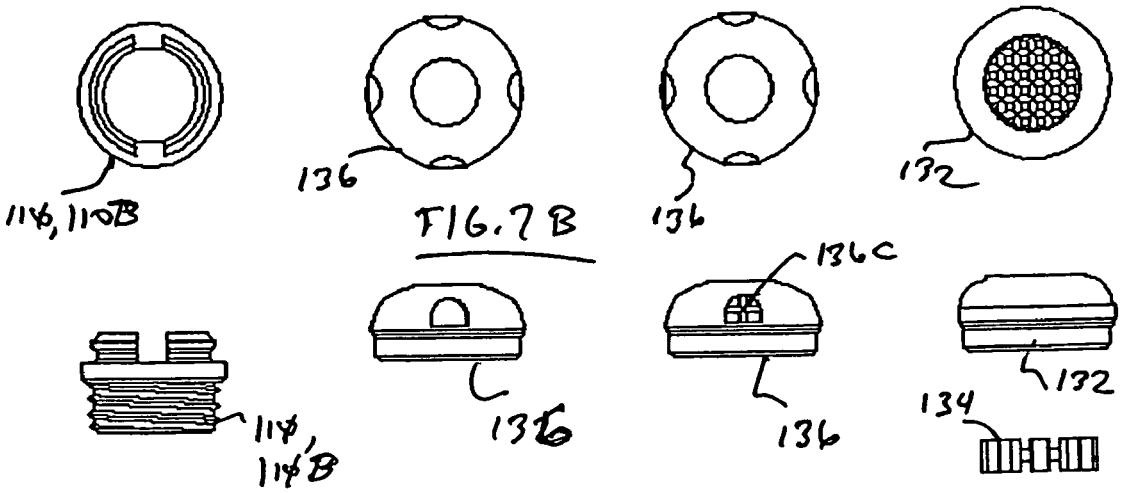
FIG. 7B
FIG. 7C

WAX BARRIER SYSTEM

BACKGROUND OF THE INVENTION

The present invention relates to an in-the-ear device for collecting cerumen (ear wax), attached to a hearing aid that can be customized to guard the hearing aid from the type of cerumen or ear wax found in a particular user's ear.

Modern hearing aids are designed to be worn in the ear of the user. These hearing aids have relatively small passageways for conducting sound. Excretions, referred to as cerumen or ear wax, from the ear tend to enter these passageways and build-up, ultimately blocking all or part of the receiver tube. If left alone, the build-up of the cerumen or ear wax can cause a serious malfunction of the hearing aid. In such cases, the hearing aid needs to be sent for repair with significant inconvenience to the user.

The patent literature contains a number of different devices for dealing with this problem. For example, U.S. Pat. Nos. 4,800,982 and 4,867,267, both to Carlson, illustrate an in-the-ear hearing aid having a cleaning passage which is accessible from outside of the hearing aid housing and which connects to the inner end of the sound outlet passage. Internal cleaning of the hearing aid is effected by pumping a solvent through a conduit formed by the cleaning passage, an acoustic chamber, and a sound outlet passage.

U.S. Pat. No. 4,984,277 to Bisgaard et al. and U.S. Pat. No. 5,401,920 to Oliveira illustrate the use of filter elements in a hearing aid. The Bisgaard et al. patent illustrates a hearing aid having an exchangeable, external filter element which snaps onto a sound conduction tube. The Oliveira patent illustrates a disposable wax guard affixed over the sound outlet port of a hearing aid, which guard is adhered to sides of the hearing aid. The portion of the guard which overlies the sound outlet port is configured to be porous to sound and receptive to cerumen.

U.S. Pat. No. 4,945,569 to Kulman relates to an ear wax-protective device having a yoke joined to an auditory passage portion of a hearing aid. Supposedly, this arrangement makes it possible to easily remove accumulations of earwax without damaging sensitive electrical components in the hearing aid.

U.S. Pat. No. 5,099,947 to Guggenberger et al. illustrates a wax guard for hearing aids. The wax guard is in the form of a coil of wire which is interference fitted within the receiver to provide a restrictive path for ear wax.

U.S. Pat. No. 5,278,360 to Carbe et al. relates to a wax guard system having a housing secured to the hearing aid shell and an insert which screws into the housing. The insert has a body having an internal passage therethrough and a bridge extending across the exterior opening of the passage. The bridge is higher at its center than at its ends and carries a thin domed disk which shields the opening and deters wax from entering the passage.

U.S. Pat. No. 5,105,904 to Olsen illustrates a cerumen trap for hearing aids which comprises a sound channel and a plurality of perforations arranged in a stellate pattern around the sound channel which connects the sound outlet of an earpiece with the sound channel. A cylindrical component with a connecting piece which surrounds the sound channel is inserted in the hearing aid. A number of angle brackets with locking detents are arranged on the periphery of the component. The sound outlet opening can be closed off from the exterior by a cap which has a locking groove on the inner wall and which engages with the locking detents.

U.S. Pat. No. 4,870,689 to Weiss and U.S. Pat. No. 5,293,008 to Danielsen illustrate other ear wax traps. The Weiss ear wax barrier includes a housing defining a central axis of passage, as well as a plurality of projections and a variable acoustic attenuator. The projections extend inwardly from the interior surface of the housing with each projection partially occluding the cross-sectional area of the housing. The projections are intended to provide a tortuous path for ear wax migrating into the hearing aid. The variable acoustic attenuator and the projections provide a constricted passageway for damping of the acoustic response of the hearing aid. The Danielsen ear wax trap includes at least one piston or plug shaped member movable relative to another component for permitting collected ear wax to be expelled from the hearing aid.

U.S. Pat. No. 5,535,282 to Luca illustrates a hearing aid having an internal duct system which prevents ear wax from reaching an electro-acoustic transducer within the hearing aid.

Many of these devices are difficult to manufacture and unnecessarily complex. Still others are difficult for patients, particularly elderly patients, to clean. Moreover, none of these devices are customizable to the type of cerumen found in a particular wearer's ear canal.

SUMMARY OF THE INVENTION

A customizable cerumen guard for a hearing aid having a shell, a receiver, a receiver tube, and aperture in the shell communicating with the receiver tube, the customizable cerumen guard further comprising:

(a) an insert adapted to be inserted into the shell aperture, the insert having a chamber therein, a receiver aperture adapted to communicate with the receiver tube, and an ear canal aperture adapted to communicate with the ear of the wearer; and (b) a plurality of customizable, interchangeable caps covering the ear canal aperture.

Additionally, the present invention may include a plurality of customizable cerumen-trapping accessories.

A principal object and advantage of the present invention is that it can be completely customized to the type of cerumen in the wearer's ear by using one of a plurality of caps and/or one of a plurality of cerumen-trapping accessories.

BRIEF DESCRIPTION OF DRAWINGS

FIG. 7A is a perspective view of various customizable caps of the present invention as related to an insert.

FIG. 7B is top plan view of various customizable caps of the present invention as related to an insert.

FIG. 7C is a side elevational view of various customizable caps of the present invention as related to an insert.

DETAILED DESCRIPTION OF THE PREFERRED EMBODIMENT

Figure 1:
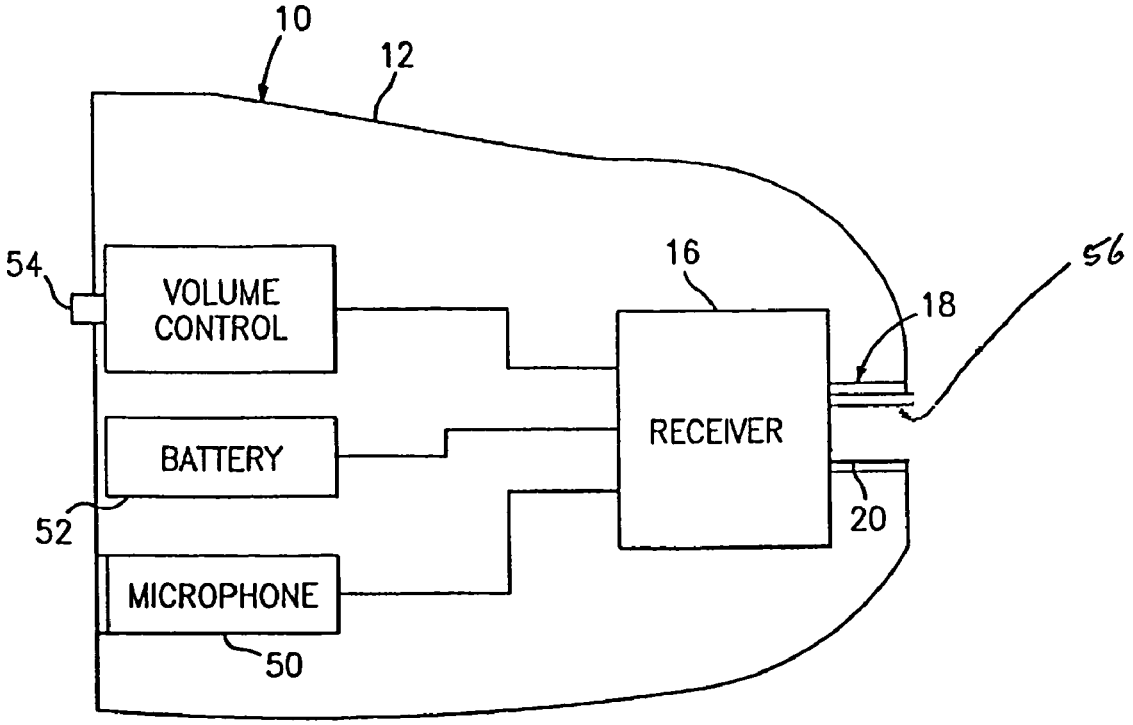
FIG. 1 (PRIOR ART)
FIG. 1 is a schematic of a hearing aid of the prior art.

Referring now to the drawings, FIG. 1 illustrates a portion of an in-the-ear hearing aid 10. The hearing aid 10 has a shell 12 shaped to conform to the shape of a human's ear canal. The shell 12 may be formed from any suitable conventional material known in the art such as vinyl plastic. The hearing aid 10 includes a number of components common to all hearing aids. For example, it includes an amplifier (not shown) and a battery assembly 52 located internally of the shell and an external volume control 54 for adjusting the sound level in the hearing aid. The external control 54 is positioned on an exterior surface of the hearing aid. Still further, the hearing aid includes a microphone 50 mounted within the shell and an acoustical connection (not shown), such as a tube, for providing access to the microphone 50 for externally arriving sound. The shell 12 has an aperture 56 opening into the ear canal of the wearer.

An acoustic transducer 16, sometimes referred to as a receiver, is mounted within a receiver tube 18 in the housing. The receiver tube 18 comprises a bore or conduit through the housing, opening into the wearer's ear canal through shell aperture 56. The diameter of the receiver tube 18 is a function of the size of the hearing aid.

The transducer/receiver 16 may have a small housing or acoustic chamber within which an acoustic driver device is mounted. If present, the acoustic driver device is electrically actuated from signals from the amplifier and mechanically connected to a diaphragm that extends across and divides the receiver housing into an outer acoustic chamber portion and an inner acoustic chamber portion. The driver is typically located within the inner acoustic chamber portion.

In operation, sound impinging the hearing aid reaches the microphone 50, which microphone generates an electrical signal representative of the sound. This electrical signal is supplied to the amplifier/battery assembly. In the amplifier, the amplitude for an output signal may be adjusted by the exterior control 54. Other characteristics such as frequency response may be controlled in a similar manner. The amplifier then supplies a signal to the transducer/receiver 16.

In order for the receiver to operate properly, the receiver tube 18 must be substantially free of cerumen or ear wax. As shown in FIG. 1, the receiver 16 is connected to the receiver tube 18. The tube 18 preferably may be formed from any flexible plastic material or rubber and is open at both ends.

Figure 2:
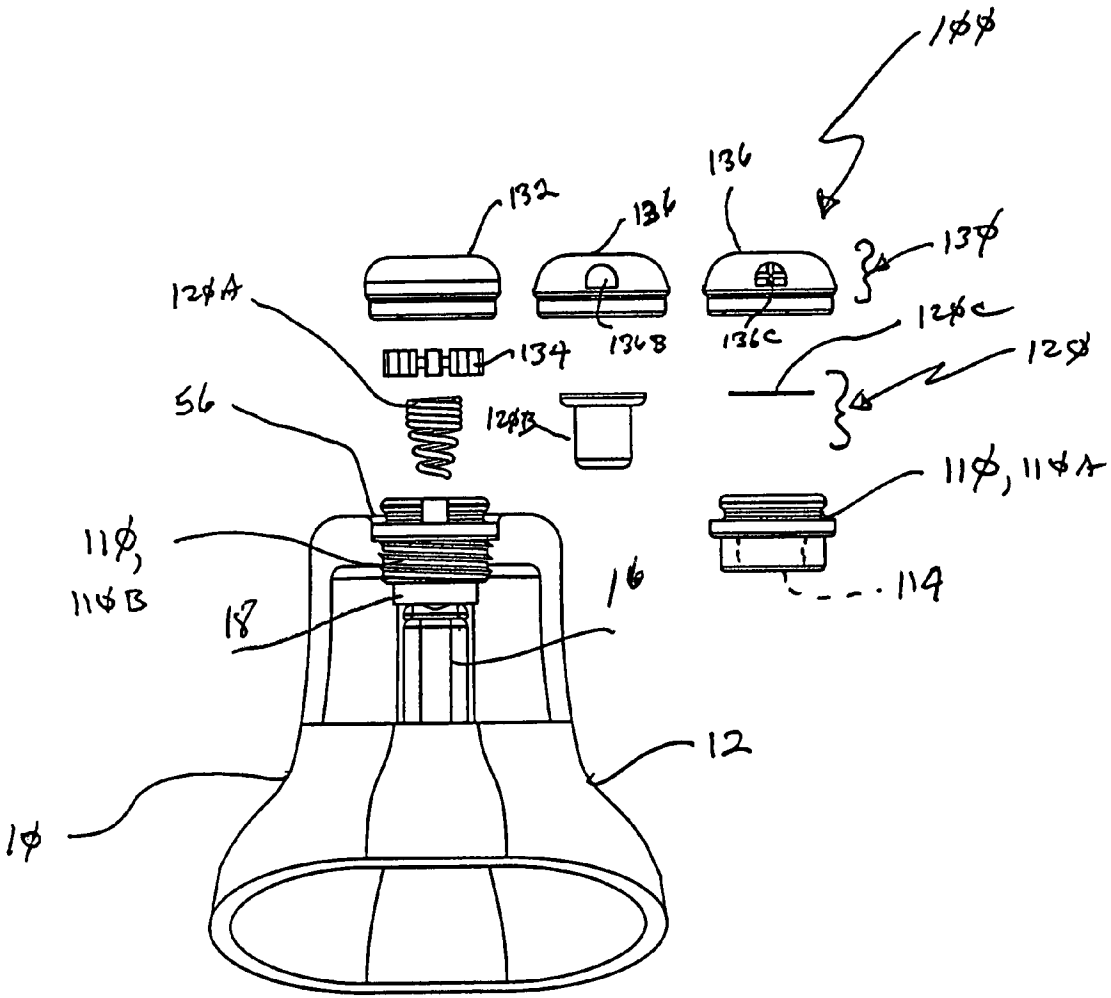
FIG. 2 is a perspective view of the cerumen guard of the present invention.
Figure 3:
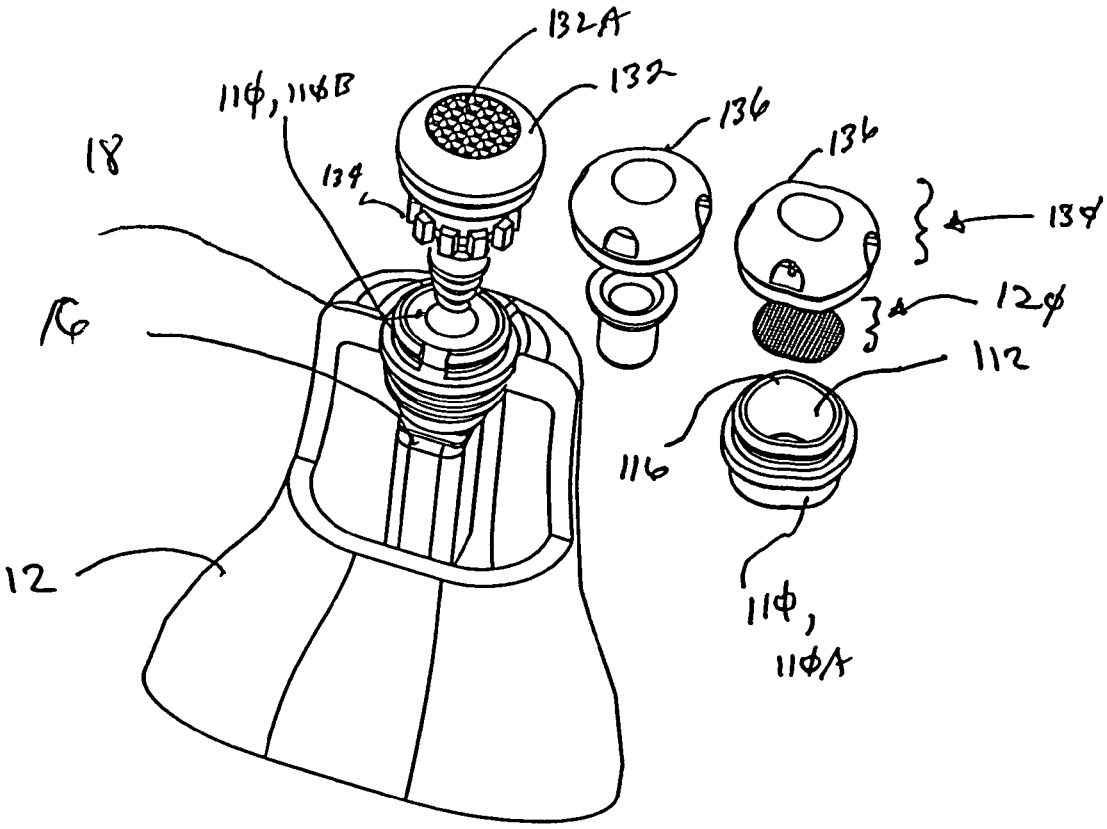
FIG. 3 is a different perspective view of the cerumen guard of the present invention.
Figure 4A:
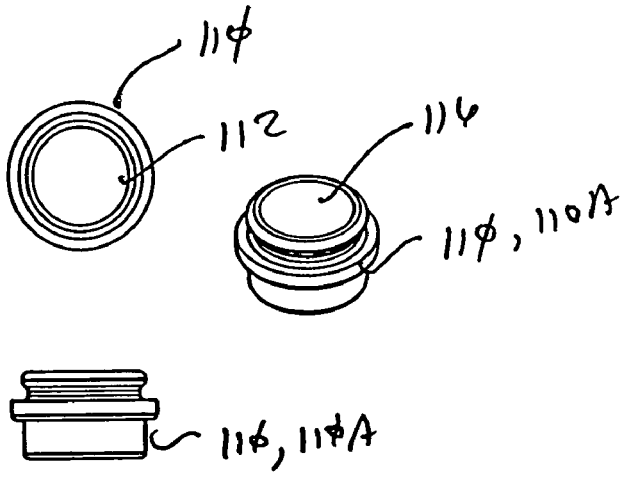
FIG. 4A shows a permanently-mounted insert from several angles.
Figure 4B:
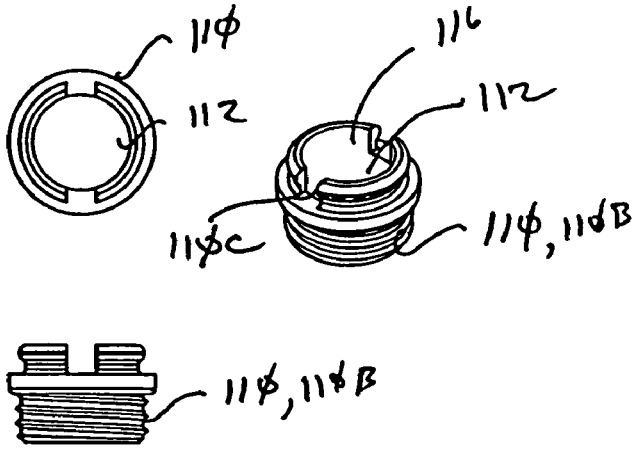
FIG. 4B shows another insert from several angles.
Figure 5B:
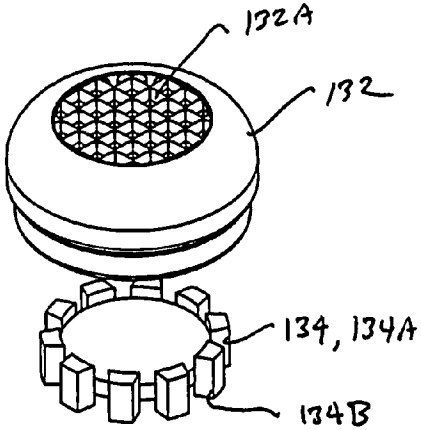
FIGS. 5A-5D are various views of a first cap of the present invention.
Figure 5C:
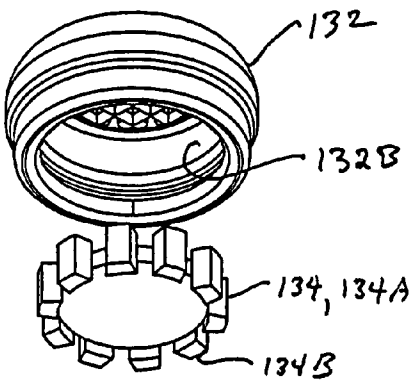
Figure 5D:
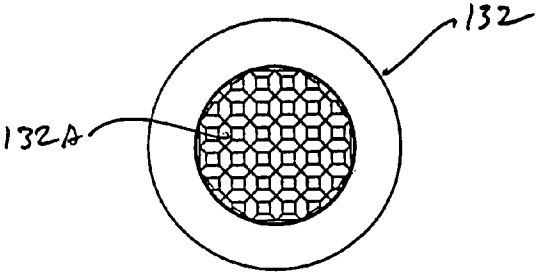
Figure 5A:
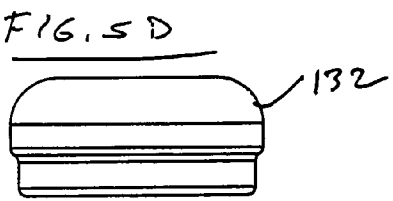
Figure 5A:
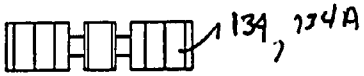
Figure 6D:
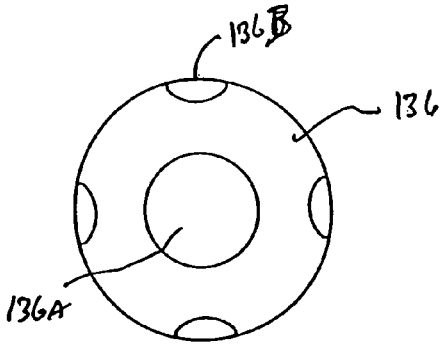
FIGS. 6A-6D are various views of a second cap of the present invention.
Figure 6B:
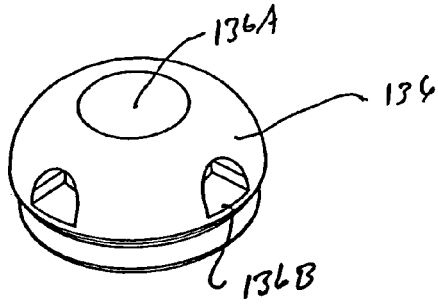
Figure 6A:
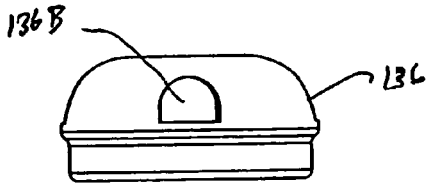
Figure 6C:
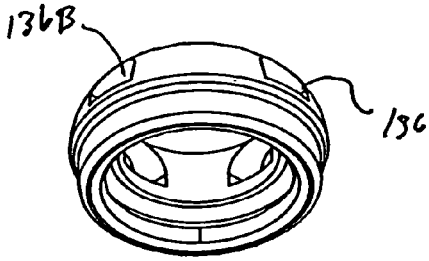

Turning to FIG. 2, the customizable cerumen guard of the present invention is generally designated as reference numeral 100. The customizable cerumen guard 100 further comprises an insert 110 adapted to be inserted into the shell aperture 56.

As may be seen in FIGS. 2, 3, 4A and 4B, the insert 110 has a chamber 112 therein. The insert 110 also has a receiver aperture 114 adapted to communicate with the receiver tube 18 and an ear canal aperture 116 adapted to communicate with the ear of the wearer.

As seen in the Figures, the insert 110 may comprise a first embodiment 110A that is permanently mounted in the shell aperture 56, for example by an adhesive. In another preferred embodiment, the insert 110B is screwed into the shell aperture 56. As seen in the Figures, the customizable cerumen guard 100 may also preferably comprise a plurality of cerumen-trapping accessories 120 insertable into the chamber 112.

The cerumen-trapping accessories 120 may include, but are not limited to, a group consisting of a wax coil 120A, a wax basket 120B, and a wax filter 120C.

As seen in the Figures, the customizable cerumen guard 100 may also preferably comprise a plurality of customizable, interchangeable caps 130 covering the ear canal aperture 116. In one embodiment (FIGS. 5A-5D), one of the plurality of customizable, interchangeable caps 130 comprises a cap 132 having a mesh covering 132A covering the ear canal aperture 116. In this embodiment, the cap 132 has a chamber 132B therein and a cerumen-spreading device 134 is insertable into the chamber 132B adjacent the mesh 132A. As seen, the cerumen-spreading device 134 preferably comprises a wheel of gear-shaped part 134A that has a plurality of fingers 134B arranged circumferentially. As cerumen enters the chamber 132B through the mesh 132A, the cerumen is forced radially outward and spread by the fingers 134B, so that it tends not to clog the insert 110.

In another embodiment (FIGS. 6A-6D), one of the plurality of customizable, interchangeable caps 130 comprises a cap 136 having a central opening 136A and a plurality of peripheral openings 136B. In this embodiment, cerumen entering the cap 136 through the central opening 136A is forced outward and spread through the peripheral openings 136B so that it does not enter the insert 110. The peripheral openings 136B may have a cross-shaped insert 136C (FIG. 2) to further enhance the spread of the cerumen. In use, the hearing aid technician, in conjunction with the wearer, chooses a particular cap that, depending on the consistency of the wearer's cerumen, is most efficient in preventing the cerumen from blocking the insert 110 and thereby the receiver tube 18. Depending on the type of cerumen, the technician may also insert one of the plurality of cerumen-trapping accessories 120 into the chamber 112, to further eliminate the chance of cerumen blocking the insert 110 and the receiver tube 118.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A customizable cerumen guard for a hearing aid having a shell, a receiver, a receiver tube, and aperture in the shell communicating with the receiver tube, the customizable cerumen guard further comprising:

a hollow, cylindrical insert adapted to be inserted into the shell aperture, the insert including:

an inside surface of the insert defining a chamber adapted to directly receive a cerumen-trapping accessory, an ear canal aperture adapted to communicate with the ear of a wearer, where the insert includes a surface surrounding the ear canal aperture defining a ridge, and a receiver aperture adapted to communicate with the receiver tube; and a plurality of customizable caps each having an inner-cap surface to engage the ridge of the insert to releasably attach one of the customizable caps with the insert and a central opening in communication with a number of peripheral openings, where the peripheral openings further include a cerumen-spreading device positioned in the peripheral openings.

2. The customizable cerumen guard of claim 1, wherein the insert is permanently mounted in the shell aperture.

3. The customizable cerumen guard of claim 2, wherein the insert is mounted in the shell aperture with adhesive.

4. The customizable cerumen guard of claim 2, wherein the insert is screwed into the shell aperture.

5. The customizable cerumen guard of claim 1, wherein the cerumen-trapping accessories are selected from the group consisting of a wax coil, a wax basket, and a wax filter.

6. The customizable cerumen guard of claim 1, wherein one of the plurality of customizable caps further comprises a cap having a mesh covering the ear canal aperture.

7. The customizable cerumen guard of claim 6, wherein the cap has a chamber therein arid further comprising a cerumen-spreading device insertable into the chamber adjacent the mesh.

8. A customizable cerumen guard for a hearing aid having a shell, a receiver, a receiver tube, and aperture in the shell communicating with the receiver rube, the customizable cerumen guard further comprising:

a hollow, cylindrical insert adapted to be permanently mounted into the shell aperture with adhesive, the insert including:

an inside surface of the insert defining a chamber, where a wax coil is positioned in the chamber, an ear canal aperture adapted to communicate with the ear of a wearer, where the insert includes a surface surrounding the ear canal aperture defining a ridge, and a receiver a aperture adapted to communicate with the receiver tube; and a plurality of customizable caps each having an inner-cap surface to engage the ridge of the insert to releasably attach one of the customizable caps with the insert and a central opening in communication with a number of peripheral openings, where the peripheral openings further include a cerumen-spreading device positioned in the peripheral openings.

9. The customizable cerumen guard of claim 8, wherein one of the plurality of customizable caps further comprises a cap having a mesh covering the ear canal aperture.

10. The customizable cerumen guard of claim 9, wherein the cap has a chamber therein and further comprising a cerumen-spreading device insertable into the chamber adjacent the mesh.

11. The customizable cerumen guard of claim 8, wherein one of the plurality of customizable caps further comprises a cap having a central opening and a plurality of peripheral openings.

12. A customizable cerumen guard for a hearing aid having a shell, a receiver, a receiver tube, and aperture in the shell communicating with the receiver tube, the customizable cerumen guard further comprising:

a hollow, cylindrical insert adapted to be screwed into the shell aperture, the insert including:

an inside surface of the insert defining a chamber adapted to directly receive a cerumen-trapping accessory, an ear canal aperture adapted to communicate with the ear of a wearer, where the insert includes a surface surrounding the ear canal aperture defining a ridge, and a receiver aperture adapted to communicate with the receiver tube; and a plurality of customizable caps each having an inner-cap surface to engage with the ridge of the insert to releasably attach one of the customizable caps with the insert and a central opening in communication with a number of peripheral openings, where the peripheral openings further include a cerumen-spreading device positioned in the peripheral openings.

13. The customizable cerumen guard of claim 12, wherein the cerumen-trapping accessories are selected from the group consisting of a wax coil, a wax basket, and a wax filter.

14. The customizable cerumen guard of claim 12, wherein one of the plurality of customizable caps further comprises a cap having a mesh covering the ear canal aperture.

15. The customizable cerumen guard of claim 14, wherein the cap has a chamber therein and further comprising a cerumen-spreading device insertable into the chamber adjacent the mesh.

* * * * *